United States Patent [19]

Uchida et al.

[11] 4,220,518

[45] Sep. 2, 1980

[54] METHOD FOR PREVENTING COKING IN FLUIDIZED BED REACTOR FOR CRACKING HEAVY HYDROCARBON OIL

[75] Inventors: Seiichi Uchida, Urawa; Yoshihito Satomi, Kurashiki; Norihiro Kiuchi, Hachioji; Takeo Yamagata, Takahagi; Susumu Yoshioka, Hitachi; Tomohiko Miyamoto, Takahagi; Jinichi Tomuro, Hitachi, all of Japan

[73] Assignees: Hitachi, Ltd.; Nippon Mining Co., Ltd., both of Tokyo, Japan

[21] Appl. No.: 946,426

[22] Filed: Sep. 27, 1978

[30] Foreign Application Priority Data

| | | | |
|---|---|---|---|
| Sep. 28, 1977 | [JP] | Japan | 52-115538 |
| Sep. 28, 1977 | [JP] | Japan | 52-115539 |
| Nov. 7, 1977 | [JP] | Japan | 52-132478 |

[51] Int. Cl.[2] ..... C10G 9/16; C10G 9/28; C01B 1/09; B01J 37/14

[52] U.S. Cl. ..... 208/48 R; 208/DIG. 1; 208/113; 208/125; 208/127; 208/130; 208/164; 252/418; 423/DIG. 16; 423/148; 423/658

[58] Field of Search ..... 208/48 R, 48 AA; 113/DIG. 1, 125, 127, 130; 423/DIG. 16, 148, 658

[56] References Cited

U.S. PATENT DOCUMENTS

| | | | |
|---|---|---|---|
| 2,288,613 | 7/1942 | Dill | 208/121 X |
| 2,320,118 | 5/1943 | Blaker et al. | 208/226 X |
| 2,735,806 | 2/1956 | Molstedt et al. | 208/48 R |
| 3,097,156 | 7/1963 | Johnson et al. | 208/124 |
| 3,264,209 | 8/1966 | Files et al. | 208/124 |
| 3,915,844 | 10/1975 | Ueda et al. | 208/127 |
| 3,936,371 | 2/1976 | Ueda et al. | 208/251 H |
| 3,983,030 | 9/1976 | Rosynek et al. | 208/253 |
| 4,046,670 | 9/1977 | Seguchi et al. | 208/48 AA |
| 4,097,362 | 6/1978 | McKinney et al. | 208/78 |

*Primary Examiner*—Delbert E. Gantz
*Assistant Examiner*—G. E. Schmitkons
*Attorney, Agent, or Firm*—Thomas E. Beall, Jr.

[57] ABSTRACT

In a reactor for cracking heavy hydrocarbon oil through a fluidized bed of particles of natural ores, coke-like materials are deposited on a top of the reactor or pipe inside surfaces of a transfer line from the reactor to a scrubber. To effectively scour out the deposited coke-like materials, particles of natural ores having a mean diameter of a few hundred μm is made to be contained in an effluent gas from the top of reactor, passing through the transfer line at a concentration of 1 to 40 g/m$^3$. The particles of natural ores have a good effect of scouring out the deposited coke-like materials and can keep the transfer line efficiently clean even with a small amount of the particles of natural ores, decreasing a pressure drop in the transfer line.

17 Claims, 8 Drawing Figures

METHOD FOR PREVENTING COKING IN FLUIDIZED BED REACTOR FOR CRACKING HEAVY HYDROCARBON OIL

BACKGROUND OF THE INVENTION

This invention relates to a method for removing coke-like materials deposited on a top of a reactor for thermal cracking or catalytic cracking of heavy hydrocarbon oil in a fluidized bed or on a pipe inside surface of a transfer line from the reactor to scrubber.

As one of reactors for cracking reaction, wherein heavy hydrocarbon oil such as vacuum residual oil obtained as residues by vacuum distillation of petroleum, etc. is converted to light hydrocarbon oil or gasified, a fluidized bed type reactor using particles of heat carrier or particles of catalyst (such particles will be hereinafter referred to as fluidization particles) is utilized. In a reactor, fluidization particles are filled and formed into a fluidized bed by a fluidizing gas injected into the reactor at the lower part, while keeping the fluidized bed at a predetermined temperature. Then, heavy hydrocarbon oil is supplied by atomizing to the fluidized bed thus established, and converted to a gas, light hydrocarbon oil and coke by cracking.

The resulting product gas and light hydrocarbon product oil in a vapor state leave the fluidized bed as an effluent, including the fluidizing gas, and are led from the upper space part of the reactor through a transfer line to a successive refining system including a scrubber, a distillation column, etc.

Coke deposited on the fluidization particles is led to a regenerator together with the fluidization particles and removed from the fluidization particles by such a means as combustion, etc. The fluidization particles regenerated in the regenerator are heated to a predetermined temperature, and returned to the reactor.

The product gas and light hydrocarbon product oil in a vapor state produced by the cracking of heavy hydrocarbon oil move to a scrubber through a transfer line, where a portion of high boiling point materials in light hydrocarbon product oil vapors is condensed, and deposited as coke-like material. The deposition of coke-like materials in the transfer line increases a pressure drop in the transfer line and finally clogs the transfer line. Thus, it is an important operational problem to prevent the deposition of coke-like materials or remove the deposited coke-like materials.

The following methods are known for preventing the formation of the coke-like materials.

(1) Pipe inside surface of the transfer line is made from a plurality of tapered short pipes connected one to another with sharp recesses at the connections, showing a saw-toothed form with slow rise edge parts and sharp fall edge parts alternately in a running direction of the effluent gas when viewed in the longitudinal cross-sectional direction of the transfer line, and an inert gas is made to inject into the transfer line at each of the sharp fall parts in the running direction of the product gas to reduce a chance of contacting the effluent gas with the pipe inside surface (Japanese Patent Publication No. 23406/73).

(2) An alkali metal salt is applied to the pipe inside surface of the transfer line (Japanese Laid-open Patent Specification No. 134601/74).

(3) Temperature of the pipe wall of the transfer line is made (by about 100° C.) higher than the effluent gas temperature (U.S. Pat. No. 2,881,130).

(4) A portion of coke fluidization particles is blown through to scour out the coke-like materials deposited on the pipe inside surface of the transfer line (U.S. Pat. No. 2,735,806).

Methods (1) and (2) can reduce an amount of deposited coke-like materials, but cannot prevent the deposition thereof completely.

Heating method (3) is effective, but cannot completely suppress the deposition of coke-like materials, and sometimes may increase the deposition, depending upon the temperature, to the contrary.

Method (4) for blowing through the coke particles is simple and can scour out the deposited coke-like materials, and thus is practical in this respect. However, a large amount of the coke particles must be blown through. Specifically, more than 400 pounds of coke particles must be blown through per one barrel of a charge stock, and when such a larger amount of the coke particles is recovered in a scrubber, etc. to return to the reactor together with the charge stock, a charge stock containing at least 50% by weight of the coke particles must be transferred, and many troubles are liable to occur in the scrubber and piping as cloggings by the coke particles or in pump operation, etc.

SUMMARY OF THE INVENTION

An object of the present invention is to provide a method for efficiently removing coke-like materials deposited on a top of a reactor of fluidized bed type for cracking heavy hydrocarbon oil or on a pipe inside surface of a transfer line or its neighboring walls.

Another object of the present invention is to employ a small amount of blow-through particles to remove deposited coke-like materials and facilitate an operation of scrubber and an operation to transfer a charge stock from the scrubber to the reactor.

According to the present invention, natural ores are used as the fluidization particles. The ore particles are blown up to a position near the outlet of the reactor and entrained in an effluent gas leaving the reactor at a concentration of 1–40 g/m$^3$ of ore particles, and the coke-like material deposited on the pipe inside surface is removed by the entrained ore particles. When the amount of ore particles entrained in the effluent gas is controlled by detecting a pressure drop in the transfer line, attrition of pipe inside surfaces, etc. due to too large an amount of the entrained ore particles, or clogging of the pipe due to too small an amount thereof can be prevented.

Blow-through particles are natural ores having a true density of 3–5 g/cm$^3$ and a mean diameter of 60–500 μm. Particles having said true density and said average particle size can be prepared, for example, merely by disintegrating and screening natural ores as such, or by granulating powdery ores and treating the granules by heating at about 800° to 1,300° C., thereby endowing said true density and said average particle size to the granules.

Natural ores used in the present invention include nickel ore, iron ore, copper ore, limestone, etc., and can be used alone or in mixture thereof. These natural ores are ores having a true density of 3–5 g/cm$^3$, which have an excellent cracking activity upon heavy hydrocarbon oil, etc., an excellent coking activity, and a excellent catalyst regeneration activity, and also have a good effect upon prevention of coke deposition. For example, nickel ores of such silica magnesia type as ganierite, or such iron oxide type as nickel-containing laterite, iron oxide ores such as magnetite or hematite, or copper sulfide ore, can be used as the natural ores.

Scouring effect of particles of these natural ores upon the deposited coke-like materials is considerably larger than that of the well known coke, sand grains, or pumice powders. For example, the scouring effect of the particles of these natural ores is more than 50 times as large as that of coke, and in other words the same effect as that of coke can be obtained at a 1/50 concentration of particles under the same conditions. The particles of these natural ores have an ability of removing coke-like materials, which is more than several ten times as high as that of sand grains or pumice powders. The present invention is based on a finding that the particles of natural ores have such a high ability of removing the deposited coke-like materials.

As a means for blowing a necessary amount of the particles upwardly without giving any disturbance to reaction conditions of the reactor, (a) a particle lift pipe and a device for supplying the necessary amount of the particles to the particle lift pipe, (b) shape of an insert provided at a free board part, (c) a device of controlling speed of ascending gas, etc. are employed.

The present invention will be described below in detail, referring to the accompanying drawings, in which.

Figure 1:
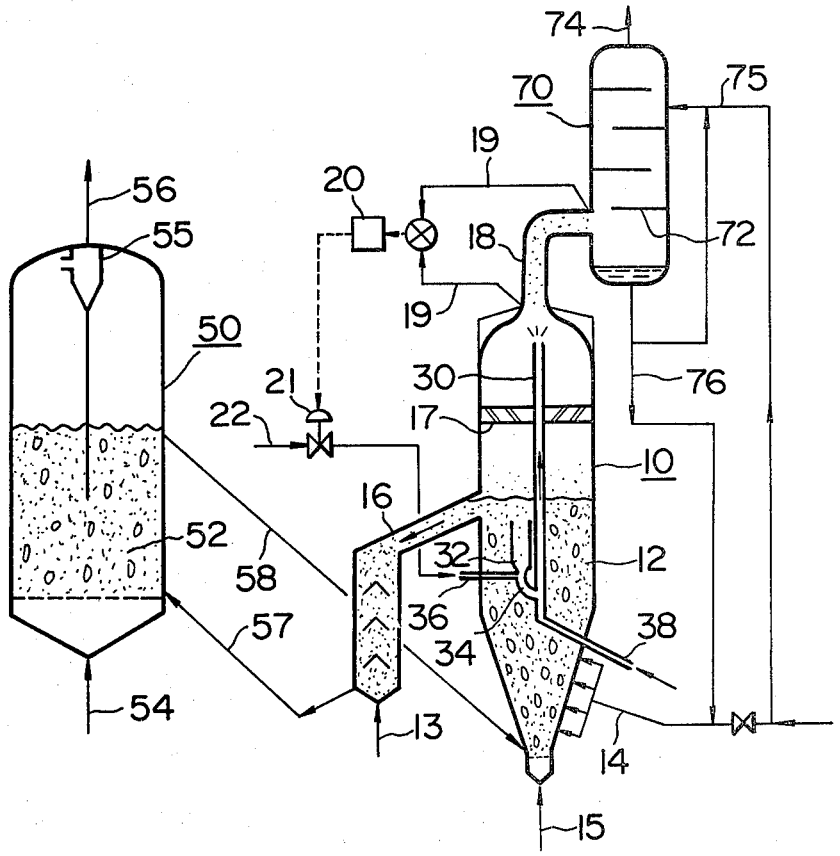
FIG. 1 is a schematic flow diagram showing one embodiment of an apparatus for fluidized bed cracking reaction according to the present invention.

A case of applying the present invention to an apparatus for fluidized bed cracking reaction is described, referring to FIG. 1.

Fluidized bed reactor 10 is supplied with feedstock heavy hydrocarbon oil from heavy hydrocarbon oil inlet 14 at the lower part thereof, and a gas for establishing a fluidized bed at fluidizing gas inlet 15 at the bottom thereof, whereby a fluidized bed 12 is established. In fluidized bed 12, the heavy hydrocarbon oil is catalytically cracked by heat carried by particles of natural ore, and converted to light hydrocarbon oil, and moves as vapors towards an upper space part of the reactor. Most of the particles entrained in the ascending gas including said vapors are removed by insert 17 provided in the upper space part, and the gas including the high hydrocarbon oil vapors enters, as an effluent gas from the reactor, into transfer line 18, and, thereafter, contacts the heavy hydrocarbon feedstock oil in scrubber 70, which has baffles 72, whereby high boiling point components and the entrained particles are removed therefrom, and the heat possessed by the effluent gas is delivered to the feedstock oil. Then, the effluent gas enters refining line 74.

The coke-deposited fluidization particles in fluidized bed 12 pass through particle discharge pipe 16 and transfer pipe 57 to regenerator 50. Steam injection pipe 13 is provided at the bottom of particle discharge pipe 16 to strip off volatile matter from the coke deposited on the fluidization particles.

In regenerator 50, coke is burnt by air introduced from air inlet 54 provided at the bottom of the regenerator. The fluidization particles are freed from coke and heated in the regenerator, and returned to fluidized bed reactor 10 through fluidization particle recycle pipe 58. The combustion gas of regenerator 50 is freed from the particles in cyclone 55, and vented through combustion gas vent pipe 56. Coke-like materials accumulated on inside wall at the top of the reactor and on pipe inside surface of transfer line 18 are mechanically scoured off by the particles blown upwardly through particle lift pipe 30. Amount of blown particles is controlled by actuating pressure difference emitter 20 by signals from pressure detector terminals 19 provided near the inlet and the outlet of transfer line 18 and actuating control valve 21 in control gas supply line 22. Fluidization particles enter into particle vessel 32 and are led to lower throttle pipe 34 according to a volume of gas from the control gas supply inlet open to the lower throttle pipe. The fluidization particles ascend through particle lift pipe 30 by means of a gas stream from lift gas supply line 38, and are mixed into the gas at the upper space part of the reactor. Some of the coke-like materials scoured out from the pipe inside surface of transfer line and suspended fluidization particles are returned to the reactor by gravity, but most of them are transferred to scrubber 70, where they contact the heavy hydrocarbon feedstock oil, solid matter is transferred into oil, and returned to fluidized bed reactor 10 through heavy hydrocarbon oil supply line 76 and heavy hydrocarbon oil inlet 14 together with the heavy hydrocarbon oil.

Figure 2:
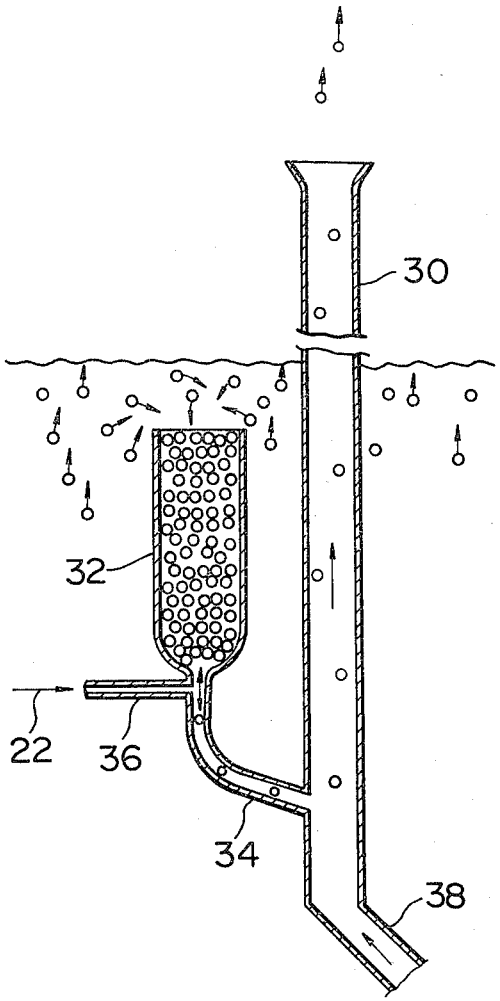
FIG. 2 is a detailed view of a device for blowing the fluidization particles upwardly according to the present invention.

Device for blowing upwardly the fluidization particles will be described, referring to FIG. 2.

Figure 3:
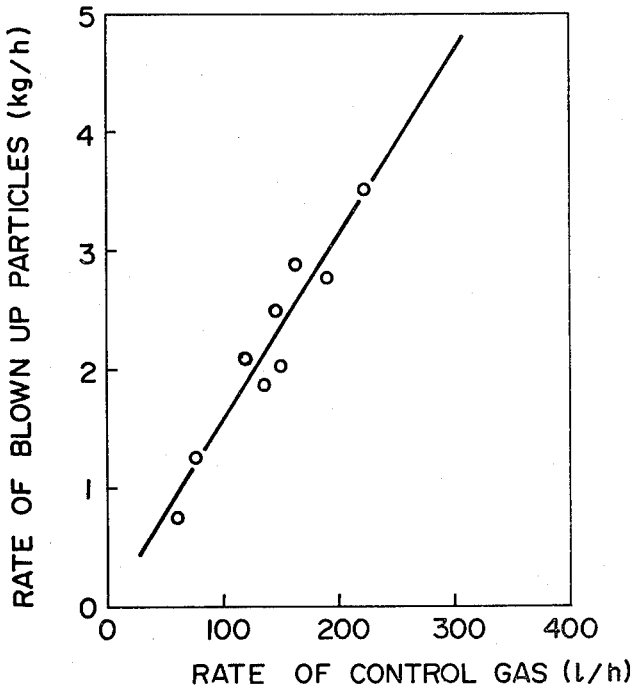
FIG. 3 is a graph showing relations between rate of blown particles and rate of control gas.

Particle vessel 32 embedded in the fluidized bed established by ascending fluidization gas is open at its top, and thus is filled with the fluidization particles falling by gravity. The lower part of the particle vessel is throttled, and a bridge of the particles is formed at the throttled part, whereby the downward movement of the particles is prevented. When a control gas is injected to the throttled part from control gas supply inlet 36, the bridge is broken by the shock of injection, and the particles flow into throttled pipe 34. The amount of particles flowing into the throttled pipe is proportional to the flow rate of control gas, and thus the rate of blown particles can be exactly regulated by controlling the flow rate of control gas, as shown in FIG. 3.

The particles descending through throttled pipe 34 are entrained in a lift gas such as nitrogen or steam from the lift gas supply line and ascend through particle lift pipe 30.

Conversion of heavy hydrocarbon oil to light hydrocarbon oil will be described, referring to the apparatus shown in FIG. 1.

Heavy hydrocarbon feedstock oil, fluidization particles heated to a predetermined temperature between 700° and 900° C. in the regenerator, and a fluidization gas are supplied to the lower part of fluidized bed reactor, and the heavy hydrocarbon oil is cracked into a gas such as hydrogen, methane, etc., light hydrocarbon oil, and coke in fluidized bed 12 having a constant temperature throughout the bed. The gas and light hydrocarbon oil vapors are led as an effluent gas to scrubber 70 from the top of the reactor through transfer line 18. In the scrubber, the effluent gas including light hydrocarbon oil vapors is subjected to gas-liquid contact with the heavy hydrocarbon feedstock oil, if necessary, admixed with light hydrocarbon oil, and washed and cooled thereby. While the gas including light hydrocarbon oil vapors leaving the fluidized bed passes through the upper space part of the reactor or transfer line 18, a portion of the high boiling point materials contained therein is condensed on the inside wall surface. The resulting condensate is coked, increasing the thickness of the deposited layer and decreasing the cross-sectional area of gas passage at the outlet of the reactor and in the transfer line. The amount of deposited coke-like materials is increased with increasing content of conradson carbon residue in the light hydrocarbon product oil, and the conradson carbon residue in the light hydrocarbon product oil depends upon reaction conditions of the fluidized bed, and kinds of fluidization particles used to establish the fluidized bed.

Blowing of the fluidization particles for removing the coke-like materials can be carried out intermittently after the coke-like materials have been accumulated to some degree, but once the accumulation of the coke-like materials starts, a pressure drop in the transfer line is liable to increase at an accelerated speed, and thus it is desirable to continuously remove the coke-like material under deposition. To protect the metallic surface of the pipe wall, the amount of blown particles is controlled to maintain some pressure difference after such a pressure difference is built up. When the fluidization particles are continuously blown while detecting the pressure difference, the amount of blown particles is liable to become excessive, giving a danger of attrition to the pipe inside surface. In such a case, pressure differences must be detected while gradually decreasing the amount of blown particles, and when the pressure differences become slightly larger than the predetermined pressure difference, the amount of blown particles is increased, whereas, when the pressure differences become slightly smaller than the predetermined pressure difference, the amount of blown particles is again gradually decreased. Such a control of the amount of blown particles can prevent making the amount of blown particles excessive that would give an abnormal attrition to the pipe inside surface, and increasing the amount of solid matter, that is, the amount of recycle fluidization particles, over the normal solid matter content of about 2% in the heavy hydrocarbon feedstock oil in the recycle line from the scrubber to the fluidized bed reactor and giving a trouble to a feed pump.

Figure 4:
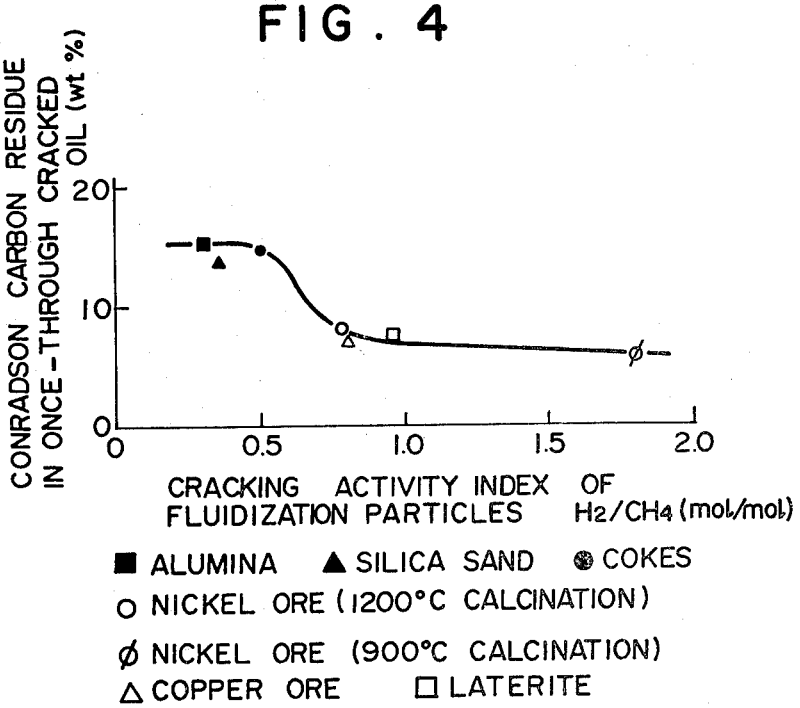
FIG. 4 is a graph showing relations between conradson carbon residue in once-through cracked oil and cracking activity index of fluidization particles for various fluidization particles.

In the present invention, particles of natural ores having a true density of 3 to 5 g/cm$^3$ are employed as the fluidization particles. As the particles of natural ores, those that are crushed or that are powder pelletized to diameter of 60 to 500 $\mu$m and calcined can be employed. Typical kinds of the natural ores used in the present invention are nickel ores, iron ores, copper ores, and limestone. These natural ores not only contribute to thermal cracking of heavy hydrocarbon oil, but also activate dehydrogenation reaction of heavy hydrocarbon oil to effectively reduce the coradson carbon content of the resulting light hydrocarbon product oil. The amount of carbon to be deposited on the pipe inside surface is proportional to the conradson carbon content of the resulting light hydrocarbon product oil, and the fluidization particles of these natural ores capable of reducing the conradson carbon content of the resulting light hydrocarbon product oil can very advantageously decrease the accumulation of coke-like materials on the pipe inside surface. Results of actual observation of relations between the conradson carbon content of the light hydrocarbon product oils in once through cracking and a cracking activity index (molar ratio of hydrogen to methane in product gas) for the individual fluidization particles are shown in FIG. 4, where a black square mark ■ shows a case using alumina as the fluidization particle, a black triangular mark ▲ silica sand, a black circular mark ● coke, a white circular mark ○nickel ores calcined at 1,200° C., a white triangular mark (Δ) copper ores, a white square mark (□) laterite, and a white circular mark with a slant line therethrough (ϕ) nickel ores calcined at 900° C. When the nickel ores, copper ores and laterite of the present invention are employed as the fluidization particles, the conradson carbon content of the resulting light hydrocarbon product oils are all less than 10% by weight, and the cracking activity indices (molar ratio of hydrogen to methane) of the fluidization particles are more than 0.7. Of course, these values depend upon kinds and cracking temperature of the feedstock oil, but have substantially similar tendencies.

As is evident from FIG. 4, the fluidization particles of the natural ores produce cracked oil having a conradson carbon content about one-half as large as that obtained when alumina, silica sand and coke are employed as the fluidization particles. Thus, the amount of coke-like materials when the fluidization particles of natural ores are employed is substantially one-half as large as that when coke is employed as the fluidization particles.

As described above, the fluidization particles of natural ores can produce a light hydrocarbon oil less capable of depositing the coke-like materials in the transfer line, and thus the trouble of depositing the coke-like materials in the transfer line can be greatly improved.

The amount of blown particles through the particle lift pipe is determined in view of a deposition rate of coke-like materials in the transfer line, and the amount of deposited coke-like materials depends upon a temperature difference between pipe wall and reactor, fluid velocity in the transfer line, and the kinds of said product oil.

Figure 5:
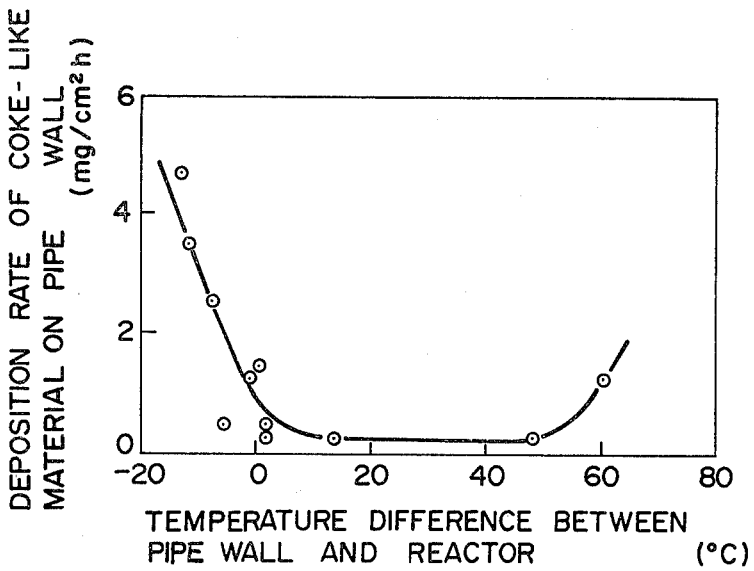
FIG. 5 is a graph showing relations between temperature difference between pipe wall and reactor, and deposition rate of coke-like material on pipe inside surface.

Relations between pipe wall temperature of transfer line and deposition rate of coke-like materials, when the particles are not blown, are shown in FIG. 5. The lower the pipe wall temperature, the more easily the high boiling point materials in the light hydrocarbon product oil are condensed, increasing the deposited amount. When the pipe wall temperature is too high, to the contrary, further cracking of the light hydrocarbon product oil is promoted on the pipe inside surface, resulting in an increase in the deposited amount. To suppress the deposition of coke-like materials to a smaller degree, the pipe of transfer line is usually thermally insulated, or sometimes positively heated to keep a temperature difference between the pipe wall and the reactor at 0° to 50° C. Since operation can be continued sufficiently stably in the present invention, even if the pipe wall temperature is made 10° C. lower than the reactor temperature, it can been seen that an ability of the fluidization particles of natural ore to scour out the coke-like materials is more than 2–4 mg/cm$^2$. hr.

A low fluid velocity in the transfer line is not preferable, because the amount of coke-like materials to be deposited on the pipe inside surface is increased. Even if blown fluidization particles are added to a slowly moving effluent gas stream, a sufficient scouring effect cannot be obtained because of a low kinetic energy of the particles. Thus, a minimum fluid flow velocity in the transfer line is about 20 m/sec.

Deposition of coke-like materials on the pipe inside surface can be considerably lowered by increasing the effluent gas flow velocity in the transfer line. It seems that the decrease in the amount of deposited coke-like materials by increasing the fluid velocity is due to a reduction in boundary layer between the pipe wall and the effluent gas stream and consequent reduction in condensation and deposition of high boiling point materials in the cracked gas. Thus, it is preferable to increase the fluid velocity, but when the fluid velocity exceeds some value, the pressure drop in the transfer line is rapidly increased even if there is no deposition of coke-like materials, and thus its upper limit is spontaneously determined. The upper limit of the fluid velocity is about 100 m/sec. Thus, the fluid velocity in the transfer line ranges from 20 to 100 m/sec.

As the fluidization particles, such natural ores as nickel ores having a true density of 3.5 g/cm$^3$, and copper ores having a true density of 4.2 g/cm$^3$, and silica sands having a true density of 2.6 g/cm$^3$ as a comparative example, were employed, and portions of these fluidization particles were blown up into the transfer line. All the blown particles had an average particle sizes of 220 to 255 $\mu$m. Blown particle concentration necessary to minimize a change in pressure drop in the transfer line was measured for the individual fluid velocities in the transfer line. Results are given in FIG. 6, where A represents nickel ores, B copper ores, and C silica sands.

Figure 6:
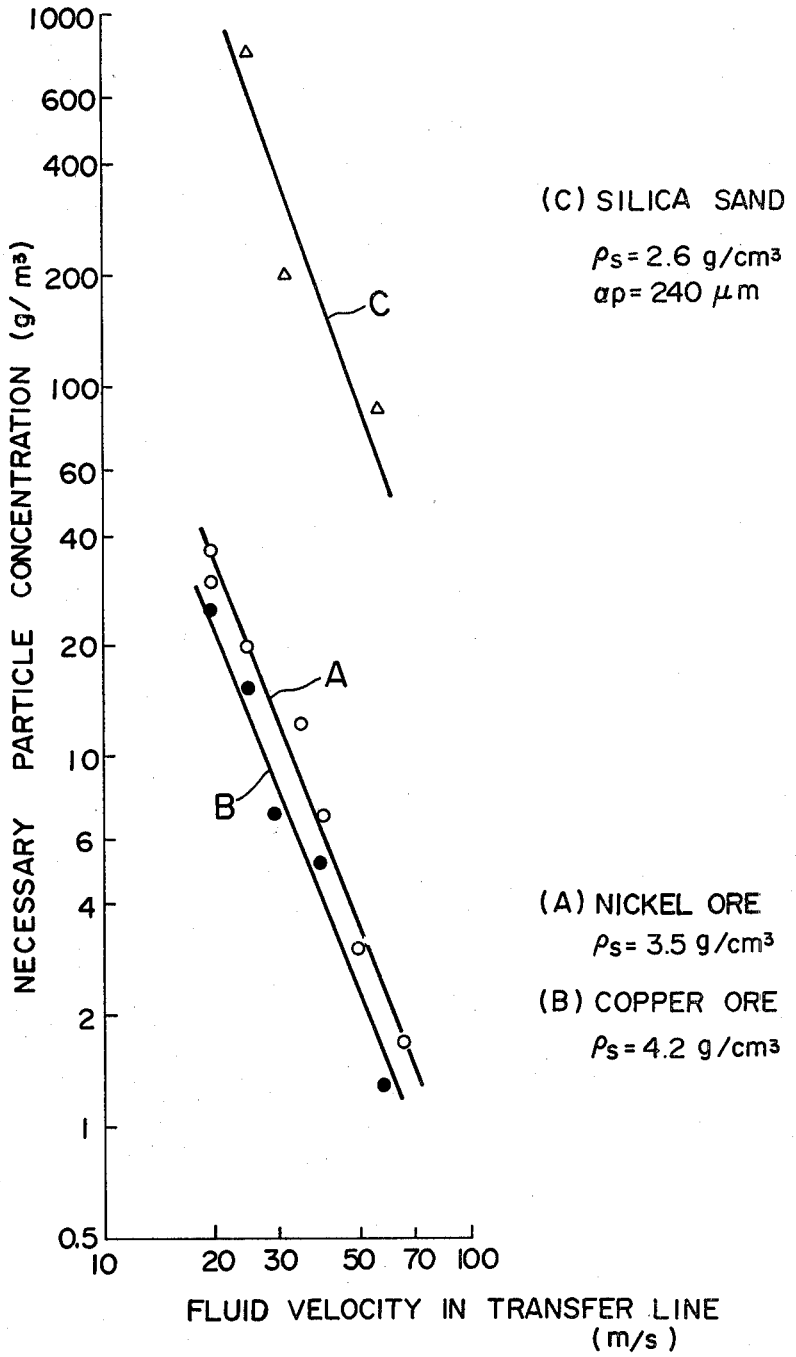
FIG. 6 is a graph showing relations between necessary concentration of blown particles and fluid velocity in transfer line.

As is evident from FIG. 6, the amount of blown particles necessary for the fluid velocity in the transfer line set to 20 to 70 m/sec is 1 to 40 g/m$^3$ for the natural ores, whereas that for silica sands as the comparative example is 50 to 1,000 g/m$^3$. An example of using coke as the fluidization particles and blown particles is disclosed in U.S. Pat. No. 2,735,806, where the necessary particle concentration in the effluent gas for removing the deposited coke-like materials is 400 to 800 pounds/barrel. When the amount of blown particles of the present invention, using the natural ores, that is, 1 to 40 g/cm$^3$, is converted into the same unit as used in U.S. Pat. No. 2,735,806, it will be 0.18 to 7.2 pounds/barrel. Comparison of the present invention with said prior art reveals that the amount of blown particles according to the present invention is less than 1/56 of that when cokes are employed.

According to the accepted theory of powder attrition, it is said that an amount of attrition (in this case a scouring effect upon coke-like materials) when particle size, roundness of particle and flow velocity are equal, is proportional to the particle density to the power 1 to 1.5. The true density of coke is 1.3 to 1.6 g/cm$^3$, whereas the true density of the natural ores of the present invention is 3 to 5 g/cm$^3$. Thus, when the natural ores are employed, it seems that the amount of blown particles can be made to 1/1.9 to 1/7 of that of coke, but according to the present invention, a very remarkable effect of reducing the amount of blown particles to less than 1/56 of that of cokes can be obtained, as described above.

Figure 7:
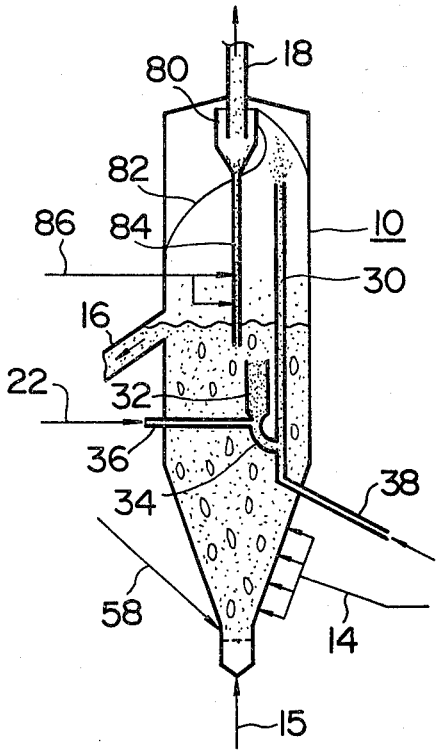
FIG. 7 is a schematic view of another embodiment according to the present invention.

In FIG. 7, another embodiment of an apparatus according to the present invention is shown, where a cyclone 80 is provided at the upper part of reactor 10.

Particle lift pipe 30 is located to blow upwardly the particles to an inlet part of cyclone 80 and remove the coke-like materials on the cyclone wall surface. Aeration gas 86 is supplied to dip leg 84 of the cyclone to change a separation efficiency of the cyclone, and the amount of particles to be supplied to transfer line 18 is controlled thereby.

Now, the present invention will be described below in detail, referring to an example.

EXAMPLE

Fluidization particles having a mean diameter of 200 $\mu$m were prepared by crushing nickel ores having a true density of 3.5 g/cm$^3$, pelletizing and calcining the resulting powders and the thus prepared particles were filled in reactor 10 having an inner diameter of 300 mm, and a height of 4 m and a shape as shown in FIG. 1 at a packing bulk density of 1.45 g/cm$^3$, and a fluidized bed 12 having a bed height of about 2 m was established with steam as fluidization gas 15.

A particle vessel 32 having an inner diameter of 27.6 mm and a height of 0.5 m was provided at a position 0.1 m below the upper surface level of the fluidized bed, while making the upper end of the vessel open. The vessel was throttled to an inner diameter of 4 mm at its bottom, and connected to particle lift pipe 30 having an inner diameter of 9.2 mm and a height of 2 m from the connected part. Furthermore, control gas conduit 36 having an inner diameter of 4 mm was provided at the throttled part.

Transfer line having a curved part, 38.4 mm in inner diameter and 1.4 m long, was provided between the reactor and scrubber 70, and a pressure difference detector having a measuring range of 1 kg/cm$^2$ was connected to both ends of the transfer line through conduits 19. An insert 17 having a cone angle of 60° and a height of 50 mm was provided at a position 0.2 m above the upper surface level of the fluidized bed in the reactor.

In the foregoing apparatus, the temperature of the fluidized bed was set to 520° C., and a superficial fluid velocity through the reactor was set to 50 cm/sec, measured on an empty reactor vessel basis. Steam was employed as particle lift gas 38 and gas flow velocity through particle lift pipe was kept at 13.2 m/sec. A nitrogen gas was used as a control gas.

Figure 8:
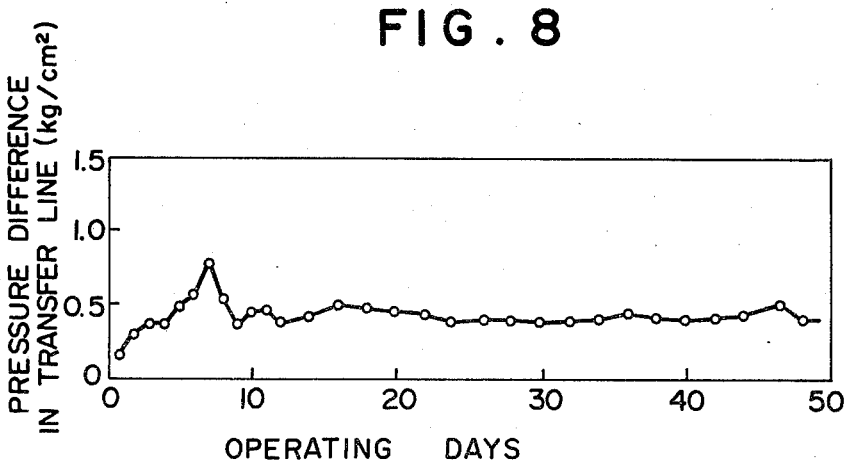
FIG. 8 is a graph showing changes in pressure difference in transfer line with operating days.

Operation was conducted initially without blowing the fluidization particles for 7 days, and then the blowing device was actuated and the operation was conducted for a continuation of 49 days. Feedstock was Kuwait vacuum residue oil, and was fed at a rate of 41.6 kg/hr. Properties of Kuwait vacuum residue oil were as follows:

Specific gravity: 1.0371 (15/4)
Conradson carbon residue: 22% by weight
Sulfur content: 5.51% by weight
Vanadium content: 115 ppm Changes in pressure difference in the transfer line are shown in FIG. 8. As is evident from FIG. 8, the pressure difference in the transfer line was rapidly increased with operating days when no particles were blown but the pressure drop could be kept at the target value by starting to blow the particles into the transfer line by the blowing device of the present invention at a particle concentration of 35 to 37 g/cm$^3$ for the first 40 hours and then at a particle concentration of 10 to 17 g/m$^3$.

What is claimed is:

1. In a method for cracking heavy hydrocarbon oil by means of an apparatus comprising a reactor column of fluidized bed type for cracking heavy hydrocarbon oil in a fluidized bed of fluidization particles formed by a fluidization gas passing upwardly therethrough, a regenerator column for burning the fluidization particles with coke deposited during the fluidization in the reactor column, thereby removing the coke from the fluidization particles and recycling the thus regenerated fluidization particles to the reactor column, and a transfer line for transferring a cracked effluent gas of the heavy hydrocarbon oil from the top of the reactor column to a successive treatment, a method for preventing coking in the reactor column of fluidized bed type which comprises using natural ores as the fluidization particles and entraining the fluidization particles in the effluent gas to be passed through the top of the reactor column through the transfer line at a rate of 1–40 g/m$^3$ of the effluent gas, while circulating a host of the fluidization particles between the reactor column and the regenerator column.

2. A method according to claim 1, wherein the particles of natural ores are selected from those of nickel ores, iron ores, copper ores, and limestone having a true density of 3 to 5 g/m$^3$.

3. A method according to claim 2, wherein the particles have an average diameter of 60 to 500 $\mu$m.

4. A method according to claim 1, providing mixing means of the fluidization particles, comprised of a particle vessel and a control gas supply inlet provided below and communicated with the particle vessel, and wherein the fluidization particles to be entrained are controlled to said rate by controlling the gas.

5. A method according to claim 2, wherein the particles of natural ores are treated by heating at about 800° to 1,300° C.

6. A method according to claim 1, wherein the effluent gas from the top of reactor through the transfer line had a fluid velocity of 20 to 100 m/sec.

7. A method according to claim 1, wherein an insert for inhibiting passage of the fluidization particles towards the transfer line, accompanying the effluent gas, is provided in an upper space part of the reactor column, a lift gas supply line is provided through the insert, and the fluidization particles are entrained in the effluent gas at said rate by a mixing means of the fluidization particles provided in the lift gas supply line.

8. A method according to claim 1, wherein a pressure drop of the effluent gas through the transfer line is detected, and an amount of the fluidization particles blown up to the top of the reactor is controlled according to the detected pressure drop.

9. In a method for cracking heavy hydrocarbon oil by means of an apparatus comprising a reactor column of fluidized bed type for cracking heavy hydrocarbon oil in a fluidized bed of fluidization particles formed by a fluidization gas passing upwardly therethrough, a regenerator column for burning the fluidization particles with coke deposited during the fluidization in the reactor column, thereby removing the coke from the fluidization particles and recycling the thus regenerated fluidization particles to the reactor column, a cyclone provided at the upper space part of the reactor column for separating the fluidization particles accompanying a cracked effluent gas of the heavy hydrocarbon oil, and a transfer line for transferring the effluent gas from the top of the reactor column to a successive treatment, a method for preventing coking in the reactor column of fluidized bed type which comprises using natural ores as the fluidization particles, blowing the fluidization particles toward an inlet of the cyclone at the upper space part of the reactor column, controlling a recovery efficiency of the cyclone, thereby entraining the fluidization particles in the effluent gas to be passed through the top of the reactor column and the transfer line at a rate of 1–40 g/m$^3$ of the effluent gas, while circulating a host of the fluidization particles between the reactor column and the regenerator column.

10. A method according to claim 9, including supplying an aeration gas to a dip leg of the cyclone, thereby changing the separation efficiency of the cyclone.

11. A method according to claim 9, wherein the fluidization particles of natural ores are selected from those of nickel ores, iron ores, copper ores, and limestone having a true density of 3 to 5 g/m$^3$.

12. A method according to claim 11, wherein the particles have a mean diameter of 60 to 500 $\mu$m.

13. A method according to claim 9, wherein a pressure drop of the effluent gas at the outlet of the cyclone is detected, an amount of the fluidization particles blown up to the inlet of the cyclone is controlled according to the detected pressure drop, a pressure drop of the effluent gas in the transfer line is detected, and a recovery efficiency of the cyclone is controlled according to the detected pressure drop in the transfer line.

14. A method according to claim 11, wherein the particles of natural ores are treated by heating at about 800° to 1,300° C.

15. A method according to claim 9, wherein the effluent gas from the top of reactor through the transfer line has a fluid velocity of 20 to 100 m/sec.

16. A method according to claim 9, removing coke deposited on a cyclone wall by providing a particle lift line with a mixing means of the fluidization particles provided near an inlet part of the cyclone.

17. A method according to claim 16, providing mixing means of the fluidization particles, comprised of a particle vessel and a control gas supply inlet provided below and communicated with the particle vessel, and wherein the fluidization particles are controlled to said rate by controlling the control gas.

* * * * *